US008393654B2

(12) United States Patent
Rodriguez et al.

(10) Patent No.: US 8,393,654 B2
(45) Date of Patent: Mar. 12, 2013

(54) TURN-BUTTON WITH LEADING HELICAL END PORTION

(75) Inventors: Lawrence G. Rodriguez, Anaheim, CA (US); Philip W. Shealer, Highland, CA (US); Derrick W. English, Bristow, OK (US)

(73) Assignee: Kwikset Corporation, Foothill Ranch, CA (US)

( * ) Notice: Subject to any disclaimer, the term of this patent is extended or adjusted under 35 U.S.C. 154(b) by 1110 days.

(21) Appl. No.: 10/647,967

(22) Filed: Aug. 26, 2003

(65) Prior Publication Data

US 2005/0046202 A1 Mar. 3, 2005

(51) Int. Cl.
*E05B 3/00* (2006.01)

(52) U.S. Cl. ..... 292/336.3; 292/347; 292/358; 70/224; 16/412; 411/454

(58) Field of Classification Search ..... 292/336.3, 292/358–359, 347–349, 352, 169.17; 70/224, 70/DIG. 30, 473, 477, 483; 16/417, 432–433, 16/441, 412; 403/13–14; 411/439, 454, 411/487, 494, 498
See application file for complete search history.

(56) References Cited

U.S. PATENT DOCUMENTS

| | | | | | |
|---|---|---|---|---|---|
| 63,230 | A | * | 3/1867 | Dickson | 70/407 |
| 266,388 | A | | 10/1882 | Prouty | |
| 455,334 | A | | 7/1891 | Iske et al. | |
| 469,953 | A | | 3/1892 | Sparks | |
| 480,075 | A | | 8/1892 | Duncan | |
| 616,751 | A | * | 12/1898 | Vedder et al. | 70/493 |
| 842,834 | A | * | 1/1907 | Hurdle | 70/407 |
| 934,702 | A | * | 9/1909 | Thomas | 292/169.17 |
| 1,932,706 | A | * | 10/1933 | Neer | 70/493 |
| 2,131,458 | A | * | 9/1938 | Turner | 292/165 |
| 2,473,052 | A | | 6/1949 | Cordrey et al. | 292/150 |
| 2,497,328 | A | | 2/1950 | Smith et al. | 292/169 |
| 2,662,387 | A | | 12/1953 | Hagstrom | 70/146 |
| 2,709,911 | A | | 6/1955 | Russell | 70/147 |
| 2,872,236 | A | | 2/1959 | Check | 292/336.3 |
| 2,911,815 | A | * | 11/1959 | Crepinsek | 70/153 |
| 3,105,712 | A | | 10/1963 | Duvall | 292/169 |
| 3,228,218 | A | * | 1/1966 | Wilson | 70/475 |
| 3,630,053 | A | * | 12/1971 | Krakauer | 70/51 |
| 3,954,292 | A | | 5/1976 | Johnson | 292/169.17 |
| 4,108,482 | A | * | 8/1978 | Dietrich et al. | 292/165 |
| 4,169,618 | A | * | 10/1979 | Potter et al. | 292/169.15 |
| 4,384,465 | A | * | 5/1983 | Muus | 70/129 |
| 4,667,994 | A | | 5/1987 | Foshee | 292/358 |
| 4,672,829 | A | | 6/1987 | Gater et al. | 70/472 |
| 4,813,723 | A | * | 3/1989 | Anderson et al. | 292/336.3 |
| 4,926,670 | A | * | 5/1990 | Deforrest, Sr. | 70/374 |
| 5,083,823 | A | * | 1/1992 | Fann et al. | 292/359 |
| 5,140,843 | A | * | 8/1992 | Krueger | 70/429 |
| 5,291,767 | A | * | 3/1994 | Weindorf et al. | 70/370 |
| 5,335,950 | A | * | 8/1994 | Mirshafiee et al. | 292/356 |
| 5,361,614 | A | * | 11/1994 | Metcalf | 70/389 |
| 5,421,178 | A | * | 6/1995 | Hamel et al. | 70/283 |
| 5,460,417 | A | * | 10/1995 | Zuckerman | 292/175 |
| 5,577,780 | A | | 11/1996 | Justice | 292/170 |

(Continued)

FOREIGN PATENT DOCUMENTS

DE 3131182 A1 3/1983

*Primary Examiner* — Christopher Boswell
(74) *Attorney, Agent, or Firm* — Barnes & Thornburg LLP

(57) ABSTRACT

A turn-button for a lockset includes a head portion and a shaft extending from the head portion. The shaft has a leading helical end portion.

11 Claims, 1 Drawing Sheet

U.S. PATENT DOCUMENTS

| | | | | |
|---|---|---|---|---|
| 5,685,584 | A | 11/1997 | Baren et al. | 292/358 |
| 5,816,086 | A * | 10/1998 | Russell, IV | 292/336.3 |
| 5,916,281 | A | 6/1999 | Kester et al. | 70/224 |
| 5,921,119 | A * | 7/1999 | Myers et al. | 70/208 |
| 6,189,351 | B1 | 2/2001 | Eagan et al. | 70/472 |
| 6,598,440 | B1 * | 7/2003 | Armstrong | 70/472 |
| 6,745,602 | B2 * | 6/2004 | Nakasone et al. | 70/224 |
| 6,860,529 | B2 * | 3/2005 | Chong et al. | 70/467 |
| 6,925,844 | B2 * | 8/2005 | Liu | 70/375 |
| 2002/0104345 | A1 | 8/2002 | Wang | 70/472 |
| 2004/0172992 | A1 * | 9/2004 | Huang | 70/358 |
| 2006/0185409 | A1 * | 8/2006 | Sun et al. | 70/224 |

* cited by examiner

TURN-BUTTON WITH LEADING HELICAL END PORTION

BACKGROUND OF THE INVENTION

1. Field of the Invention

The present invention relates to a device for actuating a lock mechanism, and, more particularly, to a turn-button with a leading helical edge.

2. Description of the Related Art

Many locksets include a lock mechanism that may be actuated, for example, by a turn-button. The turn-button includes a shaft for engaging an aperture formed in an actuator of the lock mechanism. During assembly of the locksets, it has been found that it can be difficult at times to properly align the shaft of the turn-button for proper insertion into the aperture of the actuator of the lock mechanism.

What is needed in the art is a way to facilitate self-alignment of a shaft of a turn-button with an aperture of a lock mechanism as the shaft is inserted into the aperture.

SUMMARY OF THE INVENTION

The present invention facilitates self-alignment of a shaft of a turn-button with an aperture of a lock mechanism as the shaft is inserted into the aperture.

The present invention, in one form thereof, relates to a lockset including a lock mechanism having an aperture; an operator; and, a turn-button. The turn-button is mounted to the operator. The turn-button includes a head portion, and a shaft extending from the head portion. The shaft has a leading helical end portion for engaging the aperture of the lock mechanism.

In another form thereof, the invention relates to a turn-button for a lockset. The turn-button includes a head portion and a shaft extending from the head portion. The shaft has a leading helical end portion.

In still another form thereof, the present invention relates to a lockset including a lock mechanism that includes an actuator having an aperture; an operator; and a turn-button mounted to the operator. The turn-button includes a shaft. Means is provided for facilitating self-alignment of the shaft of the turn-button with the aperture of the lock mechanism as the shaft of the turn-button is inserted into the aperture of the lock mechanism.

An advantage of the present invention is that assembly of a lockset is simplified.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one embodiment of the invention, in one form, and such exemplifications are not to be construed as limiting the scope of the invention in any manner.

DETAILED DESCRIPTION OF THE INVENTION

Figure 1:
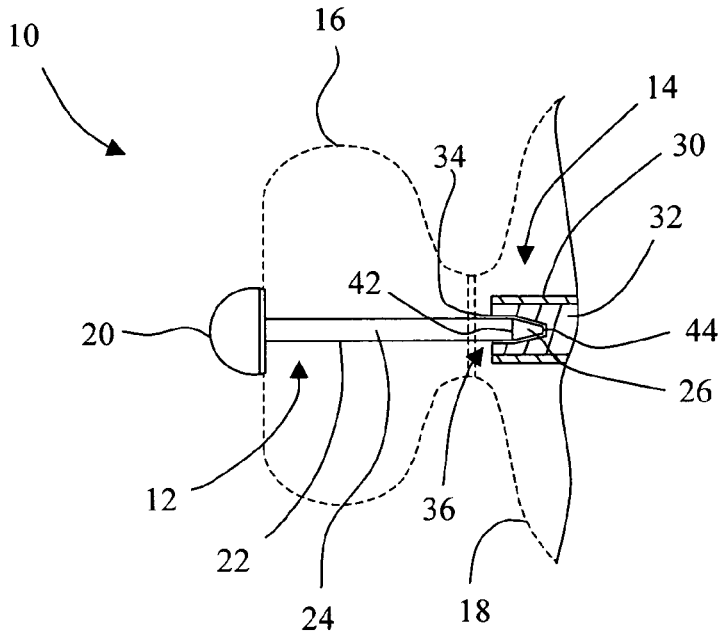
FIG. 1 is a side view of a lockset in accordance with the present invention, including a turn-button, with the operator that mounts the turn-button shown in phantom dashed lines, and with a portion of a lock mechanism shown in section.

Referring now to the drawings and particularly to FIG. 1, there is shown a lockset 10 including a turn-button 12 and a lock mechanism 14. Also, shown by phantom dashed lines is an operator 16, e.g., a door knob or lever, and a cover plate 18. Turn-button 12 may be mounted to operator 16 in a manner well known in the art.

Figure 2:
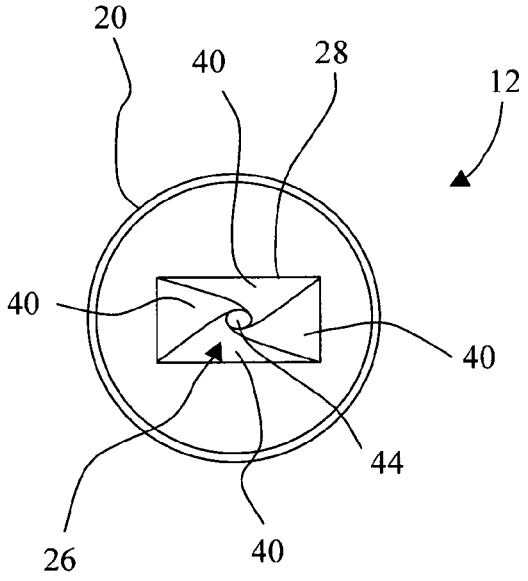
FIG. 2 is an end view of the turn-button of FIG. 1.

Referring to FIGS. 1 and 2, turn-button 12 includes a head portion 20 and a shaft 22 extending from head portion 20. A rotation of head portion 20 by a user operates lock mechanism 14. Shaft 22 includes an elongate portion 24 and a leading helical end portion 26. Elongate portion 24 has a perimeter 28 shaped, for example, as a rectangle.

Figure 3:
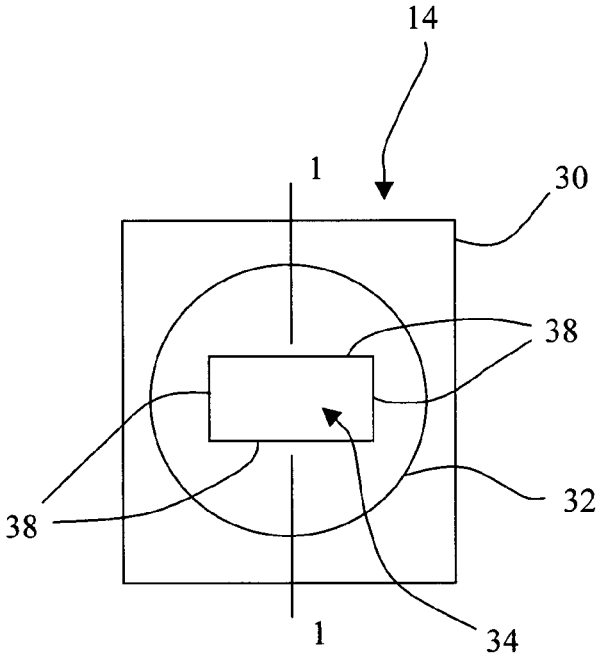
FIG. 3 is an end view of the lock mechanism that receives an engagement portion of the turn-button of FIG. 1.

Referring to FIGS. 1 and 3, lock mechanism 14 includes a housing 30, and a rotatable actuator 32 mounted in housing 30. Rotatable actuator 32 includes an aperture 34 for receiving an engagement portion 36 of shaft 22, including leading helical end portion 26. Aperture 34 has a rectangular shape defined by side walls 38 corresponding to that of perimeter 28 of shaft 22, but is sized to receive engagement portion 36 of shaft 22 in a snug sliding fit.

Referring again to FIGS. 1 and 2, leading helical end portion 26 is shaped with leading helical surfaces 40, which taper and twist from a transition line 42 of shaft 22 toward a tip end 44 of shaft 22. Further, leading helical surfaces 40 may be smoothed so that leading helical surfaces 40 smoothly transition for one to another, i.e., smoothly transition between adjacent helical surfaces.

As engagement portion 36 of shaft 22 of turn-button 12 is inserted into aperture 34, leading helical surfaces 40 of leading helical end portion 26 of shaft 22 engages one or more of side walls 38 of aperture 34 of lock mechanism 14, thereby causing turn-button 12 to rotate in a self-aligning manner until perimeter 28 corresponds with aperture 34 defined by sidewalls 38, at which time the remainder of engagement portion 36 having perimeter 28 is slid into aperture 34. Once engaged, a rotation of turn-button 12 effects a corresponding rotation of rotatable actuator 32 of lock mechanism 14.

While this invention has been described with respect to one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A lockset, comprising:

a lock mechanism having an aperture;

an operator; and a turn-button mounted in said operator during assembly of said lockset, said turn-button including:

a head portion; and a shaft extending from said head portion, said shaft having a leading helical end portion that engages said aperture of said lock mechanism, said leading helical end portion having a plurality of leading helical surfaces that taper and twist from a transition line of said shaft toward a tip end of said shaft.

2. The lockset of claim 1, wherein said plurality of leading helical surfaces smoothly transition between adjacent helical surfaces.

3. The lockset of claim 1, wherein a number of said plurality of leading helical surfaces is greater than two.

4. A turn-button for a lockset, comprising:

a head portion; and a shaft extending from said head portion, said shaft having a leading helical end tip, said leading helical end tip having a plurality of leading helical surfaces that taper and twist from a transition line of said shaft toward a tip end of said shaft.

5. The turn-button of claim 4, wherein said plurality of leading helical surfaces smoothly transition between adjacent helical surfaces.

6. The turn-button of claim 4, wherein a number of said plurality of leading helical surfaces is greater than two.

7. A lockset comprising:

a lock mechanism including an actuator having an aperture;

an operator;

a turn-button mounted in said operator, said turn-button including a shaft; and means for facilitating self-alignment of said shaft of said turn-button with said aperture of said lock mechanism as said shaft of said turn-button is inserted into said aperture of said lock mechanism, said means including a plurality of leading helical surfaces that taper and twist from a transition line of said shaft toward a tip end of said shaft.

8. The lockset of claim 7, wherein said plurality of leading helical surfaces smoothly transition between adjacent helical surfaces.

9. The lockset of claim 7, wherein said operator is one of a door knob and a door lever, said shaft of said turn-button extending through said one of said door knob and said door lever to engage said aperture of said lock mechanism.

10. The lockset of claim 7, wherein said aperture of said lock mechanism has a substantially rectangular shape.

11. The lockset of claim 7, wherein a number of said plurality of leading helical surfaces is greater than two.

* * * * *